United States Patent [19]

Lindsey

[11] 4,249,475

[45] Feb. 10, 1981

[54] PIPELINE TREATMENT APPARATUS

[75] Inventor: David L. Lindsey, Houston, Tex.

[73] Assignee: Mustang Services Company, Houston, Tex.

[21] Appl. No.: 950,246

[22] Filed: Oct. 10, 1978

[51] Int. Cl.[3] ..... B05C 7/08

[52] U.S. Cl. ..... 118/105; 118/254; 118/DIG. 10; 118/112; 15/104.06 R

[58] Field of Search ..... 118/105, 72, 112, DIG. 10, 118/254, 207; 15/104.06 R; 104.05, 51/411

[56] References Cited

U.S. PATENT DOCUMENTS

| | | | |
|---|---|---|---|
| 1,193,005 | 8/1916 | Frank | 15/104.06 R |
| 2,017,042 | 10/1935 | Dougherty | 118/105 |
| 2,133,035 | 10/1938 | Morain | 118/105 |
| 2,792,807 | 5/1957 | Cummings | 118/105 X |
| 3,135,629 | 6/1964 | McLean | 118/DIG. 10 |
| 3,885,521 | 5/1975 | Von Arx . | |

*Primary Examiner*—John P. McIntosh

*Attorney, Agent, or Firm*—William R. Laney

[57] ABSTRACT

Apparatus for treating the internal wall of a pipeline by scraping, cleaning, painting or the like, including an elongated pig, a mounting assembly connected to the trailing end of the pig, rollers movably supported on the mounting assembly for rotational movement around the longitudinal axis of the pig, for radial movement relative to the longitudinal axis of the pig, and for canting movement in which the rotational axis of each roller can be selectively skewed with respect to a chord of the diametric cross-section of a pipeline in which the apparatus is located, with the longitudinal axis of the pig coinciding with the longitudinal axis of the pipeline. Resilient biasing means is provided for constantly urging the rollers radially outwardly with respect to the longitudinal axis of the pig. A plurality of spaced surface treating elements are rotatably carried on the mounting assembly for rotation about the longitudinal axis of the pig.

2 Claims, 4 Drawing Figures

PIPELINE TREATMENT APPARATUS

BACKGROUND OF THE INVENTION

1. Field of the Invention

This invention relates to devices which are caused to traverse the interior of a pipeline and, in the course of traversal, are used for performing a desired operation upon the internal wall of a pipeline, such as painting, cleaning, scraping or the like. Particularly, the invention relates to structures associated with pipeline pigs adapted to be propelled through a pipeline, which structures bear against the internal wall of the pipeline during the course of travel of the pig and effect a desired treatment of such internal wall.

2. Brief Description of the Prior Art

As is well known in the gas and oil industry, and particularly among pipeline technologists and personnel, the extremely corrosive and abrasive wear to which the internal surfaces of pipelines used for transporting various types of hydrocarbons, brine, water or other chemical materials, are subjected, requires that such pipelines be frequently cleaned or treated so that replacement of sections of the pipeline due to excessive weakening can be deferred. This type of maintenance of the internal surfaces of the pipeline is carried out in various ways, but often involves the mounting of selected types of abrading or treating devices on a pipeline pig for movement with the pig through the pipeline. Such pigs are propelled through the pipeline by a mechanical pulling device, or more often, by fluid pressure exerted on the trailing end of the pig to propel it in a longitudinal direction through the pipeline.

Treatments of internal surfaces of pipelines which entail the application thereto of a treating fluid, such as paint, corrosion inhibitors, drying agents or a solvent, frequently achieve less than optimum results due to the fact that the paint or other treating fluid is not evenly applied. In some instances, gaps or holidays are left on the internal surface of the pipeline at locations where the treating elements used to apply the paint or other treating fluid have not made contact with the internal surface of the pipeline. Such failure of the treating elements to completely apply the treating material to the internal surface of the pipeline results in an aggravation of the problem of localized pitting or wear, and in some cases substantially decreases the service life of the pipeline due to the concentration of corrosive or abrasive forces at the untreated locale during continued use of the pipeline.

BRIEF DESCRIPTION OF THE INVENTION

The present invention provides a novel and improved apparatus which can be easily used for effectively treating the internal wall of a pipeline. The device is versatile, in that it can be used for scraping, cleaning, painting, coating or various other types of treatment in a selective manner, and by an easily performed change-out operation in which the specific type of treating element employed in the apparatus is varied to suit the particular treatment which is to be accomplished. Further, and importantly, the pipeline treating apparatus of the invention, by an induced spiraling or helical movement undergone by the apparatus as it traverses the pipeline, assures that complete coverage of the internal surface by the treating elements is realized, and no gaps or holidays are permitted to remain untreated.

Broadly described, the pipeline treating apparatus of the invention comprises an elongated pig which can be constructed in accordance with conventional and well understood principles. A mounting assembly is connected to the pig and is used for mounting to the pig for movement therewith, a plurality of rollers and treating elements. The positional relationship of the rollers to the pig and the pipeline through which it moves enables these rollers to constantly bear against the internal wall of the pipeline. The apparatus is constructed so that the rollers are supported on the mounting assembly for rotational movement about the longitudinal axes of the pig and of the pipeline through which it moves, and also for radial movement relative to this longitudinal axis.

Importantly, the rollers can be canted or skewed to selected positions with respect to a chord of the diametric cross-section of the pipeline in which the apparatus is to be used. By selectively skewing the rollers in this way, they are made to trace out a helical or spiral path on the internal wall of the pipeline as the pig is moved therethrough. By connecting to the rollers and to the mounting assembly which carries the rollers, a plurality of treating elements which are caused to duplicate the movements of the rollers on the interior of the pipeline. The treating elements can thus be made to collectively sweep out spiral paths on the interior of the pipeline which overlap, and thus assure complete coverage of the entire internal surface area of the pipeline by any fluid which is to be applied thereby by means of the treating elements carried on the mounting assembly.

An important object of the invention is to provide an improved pipeline treatment apparatus which is constructed with adjustable rollers which can be made to impart to the apparatus a spiraling or helical movement as the apparatus moves along the axis of the pipeline during treatment of the internal surface thereof.

A further object of the invention is to provide in conjunction with the rollers herein described as forming a part of the treating apparatus of the invention, a plurality of spaced surface treating elements which, in being made to undergo a spiraling movement which accords to that undergone by the rollers, continuously contact the pipeline in a plurality of overlapping spiraling paths, thus assuring complete application of any type of treating fluid to the entire area of the internal surface of the pipeline.

Another important object of the invention is to provide a pipeline treating apparatus which, by reason of its construction, can easily traverse bends or girth wells in the pipeline without any interruption of contact between the treating elements forming a part of the apparatus and the internal wall of the pipeline, and without hanging or slowing as such bends and wells are traversed by the apparatus.

Another object of the invention is to provide a pipe treating apparatus which is particularly useful for distributing corrosion inhibitors and drying agents to the internal surfaces of a pipeline.

Finally, an important object of the invention is to provide a pipeline treating apparatus which is characterized in having a long and trouble-free operating life, and which can be relatively inexpensively manufactured and can be used by personnel with relatively little technical knowledge or expertise.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
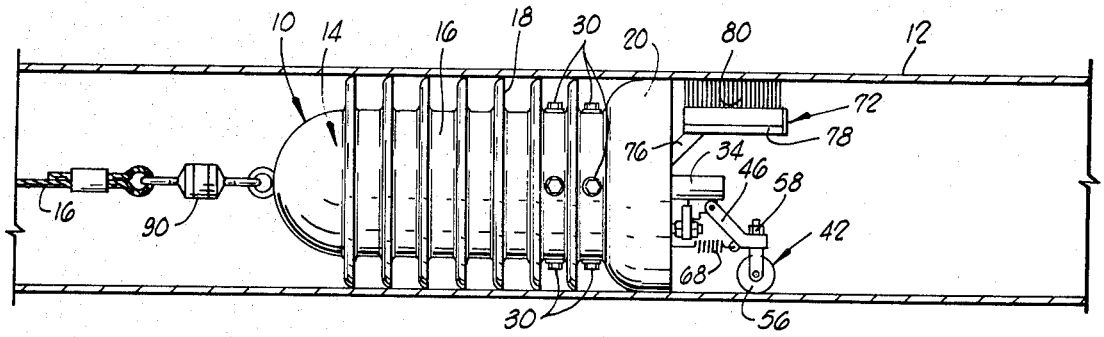
FIG. 1 is a longitudinal cross-sectional view through a part of a pipeline illustrating the pipeline treating apparatus of the present invention located on the interior of the pipeline.

In FIG. 1 of the drawings, a preferred embodiment of the pipeline treating apparatus 10 of the invention is shown disposed on the interior of a pipeline 12 undergoing treatment. The pipeline treating apparatus 10, in the form shown, includes an elongated pig designated generally by the reference numeral 14. Various constructions of pipeline pigs can be utilized in the pipe treating apparatus of the invention, and these pigs can be propelled or pulled through the pipeline in various ways well understood in the art. In the illustrated embodiment, the pig 14 is being pulled through the pipeline 12 by means of an attached cable 16. It is also within the contemplation of the invention to propel the pig through the pipeline by means of a fluid placed in the pipeline behind the pig under sufficient pressure to drive the pig to the left as the system is viewed in FIG. 1.

The illustrated pig 14 includes an elongated, generally cylindrical or tubular body portion 16 having a plurality of annular fins 18 secured around the external periphery of the body and projecting radially outwardly to a point of contact with the internal wall of the pipeline 12. At its trailing or rear end, the pig 14 terminates in a flared rearwardly extending pressure cup 20 which bears at its outer periphery against the internal wall of the pipe 12. The pig 14 can be constructed of rubber, polyurethane or various other materials conventional in the art.

Secured to the trailing or rear end of the pig 14 is a mounting assembly designated generally by reference numeral 22. The mounting assembly 22 here in use includes a generally cylindrical body 23 having a forward end and a trailing end. The forward end is closed by an internal end plate 24 which is axially spaced from an external end plate 26 which closes the trailing end of the body 23. The cylindrical body 23 is dimensioned to fit within the cylindrical body 16 of the pig 14. Suitable bolts 30 are provided for extension through the body 16 of the pig 14 and through the cylindrical body 23 of the mounting assembly 22 so as to secure the mounting assembly in the rear or trailing end portion of the pig 14. Other means are also suitable for effecting such securement.

Figure 2:
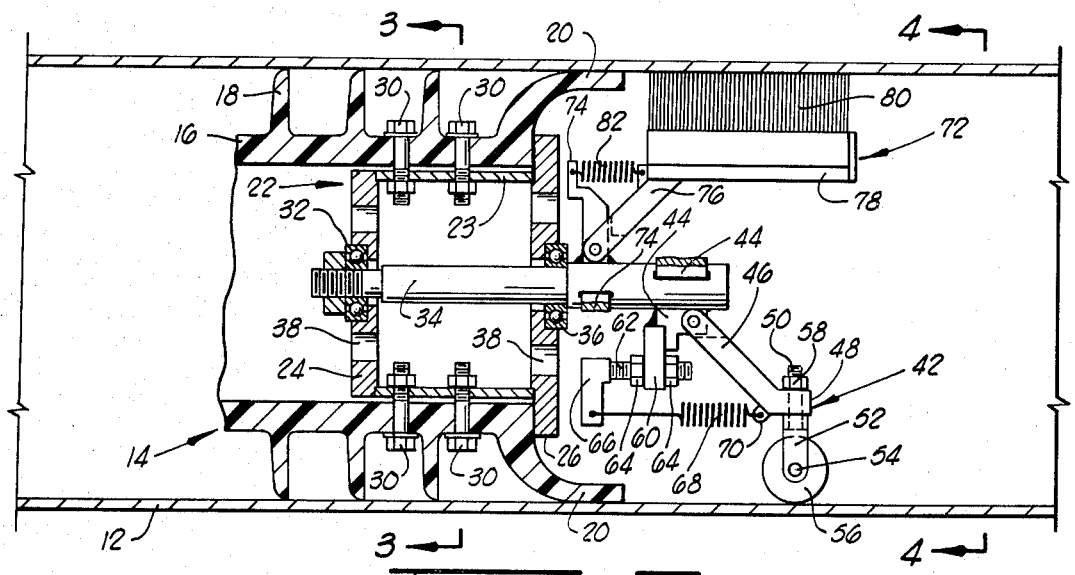
FIG. 2 is an enlarged sectional view of the rear or trailing end of a pipeline pig in which the principal and operative portions of the apparatus of the present invention are mounted.
Figure 3:
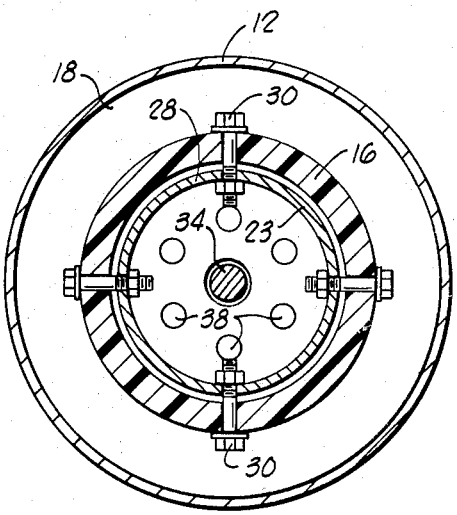
FIG. 3 is a sectional view taken along line 3—3 of FIG. 2.

It will be noted in referring to FIG. 2 that the internal end plate 24 of the cylindrical mounting assembly 22 has a central opening therein which receives a suitable bearing 32. The bearing journals the internal end of an elongated shaft 34 which is positioned coaxially with respect to the axis of the pig 14. The shaft 34 also extends through a similar bearing 36 mounted in a central opening in external end plate 26. For purposes of assuring pressure equalization inside the pig body 16, both the internal end plate 24 and the external end plate 26 are provided with a plurality of openings 38 spaced radially outwardly from the central openings which carry the bearings 32 and 36. It will be noted from FIG. 2 that the external end plate 26 is of sufficient diameter that a peripheral flange is provided by its outer portion which projects radially outwardly with respect to the cylindrical body 23 and bears against the end portion of the cylindrical body 16 of the pig 14.

At its outer end, the elongated shaft 34 has a plurality of roller subassemblies 42 mounted thereon. One of these subassemblies is illustrated in detail in FIG. 2, and a total of three such subassemblies are provided in the pipeline treating apparatus, and are spaced from each other 120° around the periphery of the shaft 34 in the manner best illustrated in FIG. 4. Each of the roller subassemblies includes a mounting bracket 44 which projects radially outwardly from the outer periphery of the shaft 34 and serves as a point of pivotal support for an arm element 46.

Figure 4:
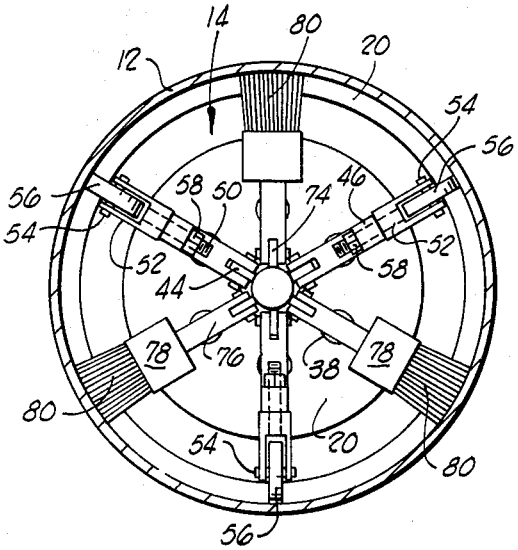
FIG. 4 is a sectional view taken along line 4—4 of FIG. 2.

The arm element 46 projects in a radial direction with respect to the shaft 34 and terminates at its outer end in a hub 48 through which is extended a stub shaft 50 connected to a clevis bracket 52 at its lower end. The clevis bracket 52 is of substantially U-shaped configuration as shown in FIG. 4, and receives through the opposed legs thereof, an axle 54 upon which is rotatably mounted a wheel or roller 56. The upper end of the shaft 50 is threaded to receive a nut 58. By loosening the nut 58, the clevis bracket 52 can be pivoted or canted, and with it the roller 56 skewed so that the roller assumes a preselected position in a plane which extends at an angle to a diametric plane of the pipeline 12. After selecting the angle of skew or canting of the roller 56 in this fashion, the nut 58 is tightened on the threaded end of the shaft 50 to retain the roller 56 in this selected position. The purpose of this pre-positioning of the rollers 56 in each of the roller subassemblies 42 will be hereinafter explained.

Each of the roller subassemblies 42 further includes a supporting plate 60 which is rigidly fixed or secured to the bracket 44 in a position of non-interference with the pivoting movement of the arm element 46. Supporting plate 60 carries an aperture through which a threaded adjusting shaft 62 is extended. The adjusting shaft 62 has a pair of nuts 64 threaded thereon and positioned on opposite sides of the supporting plate 60. By means of these nuts, the position of the adjusting shaft 62 in relation to the supporting plate 60 can be adjusted as desired.

At the end of the adjusting shaft 62 which is distally located with respect to the arm element 46, the adjusting shaft carries a spring connecting arm 66 to which one end of an elongated tension spring 68 is connected. The other end of the tension spring 68 is connected to an ear 70 carried on one side of the arm element 46. It will be perceived that the function of the tension spring 68 is to resiliently bias the arm 46 about its point of pivotal connection to the bracket 44, and thus move the roller 56 radially outwardly into contact with the internal wall of the pipeline 12.

Although only one of the roller subassemblies 42 has been described, it will be understood that all of the three roller subassemblies provided in the apparatus of the invention are constructed identically to each other.

Also secured to the rear end portion of the elongated shaft 34 are a plurality of treating element subassemblies, designated generally by reference numeral 72. In general, the treating subassemblies 72 are those portions of the apparatus of the invention which work upon or effect the treatment of the internal walls of the pipeline 12. Such treatment may include scraping, cleaning or some type of painting or coating. In the illustrated embodiment of the invention, each treating element subassembly 72 includes a wiping element or brush which functions in the manner hereinafter described to either clean the internal surface of the pipeline 12, or to apply paint, corrosion inhibitors, drying agents or the like thereto.

Each cleaning element subassembly 72 includes a spring arm having an inner end secured to the shaft 34 and projecting radially outwardly from and normal to the shaft. Each spring arm 34 is straddled by the bifurcated end portion of a brush arm element 76. Each brush arm element 76 is pivotally connected to the base of its respective spring arm 74 and supports, at its radially outer end, a bristle channel or housing 78. The bristle channel 78 functions to support the roots or base portions of a plurality of brush bristles 80 which project radially outwardly from the bristle housing as best shown in FIGS. 2 and 4.

For the purpose of biasing the brush bristles 80 outwardly against the internal wall of the pipeline 12, a tension spring 82 is extended between one end of the bristle channel 78 and the radially outer end of the spring arm 74.

Each of the treating element subassemblies 72 is constructed identically to each other such subassembly and, as shown in FIG. 4, three of these subassemblies are spaced circumferentially from each other around the shaft 34 on a spacing of 120° with the brush subassemblies interspaced with the roller subassemblies 42 as shown in FIG. 4.

OPERATION

In the use and operation of the pipeline treating apparatus of the invention, the pig 14 is propelled through the pipeline 12 in any suitable fashion which will preferably permit it to turn freely in the pipeline. For illustrative and discussion purposes, the pig 14 is shown to be moved through the pipeline by means of a towing cable 16 connected to the nose or forward end of the pig by means of a suitable swivel connection 90. The pig is thus free to rotate within the pipeline by reason of the swivel.

It is also characteristic of the use of the pipeline treating apparatus of the invention that the pig be followed by a body of treating material, such as a cleaning solvent, paint or the like. It should be pointed out, however, that in some instances, the treatment may consist merely of scraping or abrading the internal walls of the pipeline 12, in which case a fluid need not be placed behind the pig unless it is to be used for propulsion purposes.

Prior to placing the pipeline treating apparatus in operation, the particular type of treatment to be imparted to the internal wall of the pipeline will determine the particular sort of treating element used in each of the treating element subassemblies 72. Thus, though bristle-type brushes 80 are illustrated in the drawings, a flexible rubber wiper blade may be used in some instances, a steel brush may be employed in other instances, or substantially any type of working tool can be carried at the outer end of the treating element arm 76 in a position to bear against the internal wall of the pipeline and work upon or treat this surface in a manner desired.

Prior to commencing the longitudinal travel of the apparatus through the pipeline, provision is made to cause at least a portion of the apparatus to undergo a spiraling movement within the pipeline. Stated differently, in order to assure complete contact of the entire internal wall of the pipeline 12 by the treating elements used, and by a treating fluid which is to be deposited thereon by means of the treating elements, it is desirable that the treating element subassemblies rotate about the longitudinal axis of the pipeline so that the treating elements in contact with the internal wall thereof sweep out helical paths which completely cover the entire surface area of the inside wall of the pipeline.

To effect such rotational movement of the treating element subassemblies, the rollers 56 are canted to dispose them in an angular relationship with respect to a diametric plane passed through the pipeline. Stated differently, the axle 54 about which each wheel 56 rotates is made to lie at an angle with respect to a chord of the circular cross-section of the pipeline. The magnitude of this angle will determine the rate of rotation of the treating element subassemblies 72 within the pipeline, and will, of course, be selectively adjusted in relation to the type of treatment which is to be applied to the internal wall of the pipeline. The manner of adjusting the angulation of the rollers 56 has been previously alluded to, and entails merely loosening the nut 58 on the threaded end of the shaft 50 to permit the clevis bracket 52 and wheel 56 to be canted as desired, and then retightening the nut on the shaft. The same angulation is imparted to each one of the wheels 56 in each of the roller subassemblies 42.

It should be pointed out that the force with which the roller carried in each roller subassembly bears against the internal wall of the pipeline 12 can be adjusted by adjusting the tension of each of the tensioning springs 68 as a result of varying the position of adjusting shaft 62.

Having adjusted the angle of canting of the rollers 56 in the manner described, the apparatus is ready for use in treating the internal wall of the pipeline 12. At this time, a liquid, such as paint, may be caused to enter the pipeline behind the pig 14 and partially fill the pipeline behind the pig. As the pig is pulled through the pipeline, the amount of paint within the pipeline is maintained at a substantially constant level. The paint in the lower portion of the pipeline is constantly swept up by the bristles 80 of the brushes constituting the treating elements and is wiped against the internal wall of the pipeline with a rotary, spiraling motion which assures complete coverage of the entire wall of the pipeline.

As previously pointed out, other types of treatment may typically include scraping, cleaning with a suitable cleaning solvent, or abrading.

Typically, the three-wheeled, three treating element system illustrated as one embodiment of the present invention works suitably for pipelines of about 8″ diameter. In larger diameter pipelines, however, additional wheels and treating elements can easily be added by affixation to the elongated shaft 34 to provide enhanced stability to the apparatus, and to assure overlapping of the helical paths followed by the treating elements.

It should be pointed out that spring loading of the roller subassemblies and of the treating element subassemblies allows the apparatus to flex along a longitudinal axis and thus to easily traverse turns or bends in the pipeline. The spring loading aspect also permits the traversal of girth wells and other anomalies encountered along the length of the pipeline.

Although a preferred embodiment of the invention has been herein described, it will be understood that various changes and modifications in the illustrated and described structure can be effected without departure from the basic principles which underlie the invention. Changes and modifications of this type are therefore deemed to be circumscribed by the spirit and scope of the invention except as the same may be necessarily modified by the appended claims or reasonable equivalents thereof.

What is claimed is:

1. Apparatus for treating the interior surface of a pipe comprising:

mounting means adapted for longitudinal movement through the pipe, which means includes:

a tubular pig having a leading end and a trailing end;

a cylindrical tubular body having a leading end, and having a trailing end dimensioned for insertion into the trailing end of the pig, said body having at least one hole in its wall for passage of an anchoring means therethrough to secure the tubular body in the pig;

a flat circular end plate across the leading end of the body, having a central opening formed therein for receiving a bearing;

a flat end plate dimensioned to overlap the trailing end of the cylindrical body and forming a flange abutting the trailing end of the pig when the leading end of the tubular body is inserted therein, and having a central opening for receiving a bearing;

a bearing secured in each of said central openings;

roller means connected to said mounting means and including:

at least one roller means skewable to selected positions for rolling contact with the internal wall of the pipe along a helical path as the mounting means is moved longitudinally through the pipe; and means for continuously resiliently biasing said roller means outwardly in a radial direction regardless of the position to which said roller means are skewed;

a treating element connected to the mounting means for movement therewith; and means interconnecting said roller means and treating element to cause the treating element to contact the internal wall of the pipe along a helical path which is complementary in configuration to the path traced out by said roller means as said roller means undergoes rolling contact with the internal wall of the pipe as said mounting means is moved longitudinally through the pipe, and wherein said means interconnecting said roller means and treating element comprises a shaft to which said roller means and treating element are pivotally connected, which shaft is mounted through said bearings and extends axially outward from said trailing end of said tubular pig.

2. Apparatus for treating the interior surface of a pipeline comprising:

a hollow pig having a first end and a second end and adapted for longitudinal movement through a pipeline;

a mounting assembly secured to at least one of said ends of the pig and including:

a cylindrical tubular body having a leading end and a trailing end and dimensioned for insertion into the trailing end of the pig;

means for detachably securing the tubular body in the hollow pig;

a shaft rotatably mounted in said cylindrical body for coaxial rotation relative to the axis of the pipeline;

at least two arm elements pivotally secured to said shaft for radial movement with respect thereto in a plane parallel to the shaft;

spring means interconnecting each arm element and said shaft for biasing the respective arm element radially outwardly toward contact with the interior of the pipeline;

a first end plate secured to the leading end of the body;

a bearing in said first end plate receiving an end of said shaft;

a second end plate secured across the trailing end of the cylindrical body and forming a peripheral flange abutting the trailing end of the pig body when the cylindrical body is inserted therein; and a bearing in said second end plate receiving said shaft therethrough;

roller means connected to at least one arm element and skewable to selected positions for rolling contact with the internal wall of a pipeline along a helical path as the apparatus is moved longitudinally through the pipeline; and treatment means connected to at least one arm element for treating the surface of the pipeline as the apparatus moves longitudinally through the pipeline.

* * * * *